US005716226A

United States Patent [19]

Takahashi et al.

[11] Patent Number: 5,716,226

[45] Date of Patent: Feb. 10, 1998

[54] CONNECTOR FOR CONNECTING FLEXIBLE FLAT CABLE TO PRINTED WIRING BOARD

[75] Inventors: Wataru Takahashi, Tokyo; Kenichi Hatakeyama, Iwate, both of Japan

[73] Assignee: NEC Corporation, Tokyo, Japan

[21] Appl. No.: 616,535

[22] Filed: Mar. 15, 1996

[30] Foreign Application Priority Data

Mar. 15, 1995 [JP] Japan ..... 7-055464

[51] Int. Cl.[6] ..... H01R 13/62

[52] U.S. Cl. ..... 439/329; 439/545

[58] Field of Search ..... 439/67, 329, 545, 439/493, 492, 495

[56] References Cited

U.S. PATENT DOCUMENTS

| | | | |
|---|---|---|---|
| 4,235,500 | 11/1980 | Belopavlovich et al. | 439/67 |
| 4,948,374 | 8/1990 | Carter | 439/329 |
| 4,948,379 | 8/1990 | Evans | 439/329 |
| 5,213,534 | 5/1993 | Gardner et al. | 439/495 |

FOREIGN PATENT DOCUMENTS 4-129186 4/1992 Japan .

*Primary Examiner*—Neil Abrams
*Assistant Examiner*—Yong Ki Kim
*Attorney, Agent, or Firm*—Sughrue, Mion, Zinn, Macpeak & Seas, PLLC

[57] ABSTRACT

The present invention provides cable connector including (a) a plurality of contacts one end of which has connecting means for connecting the contacts to a cable conductors extending from a flat cable, (b) a supporting frame having an opening therein and an insulator portion for supporting the plurality of contacts intermediate between opposite ends of the contacts so that the contacts are electrically insulated from one another and the other end of the plurality of contacts are able to make contact with a pad disposed on a printed wiring board through the opening when the cable connector is mounted on the printed wiring board, and a projection formed on the supporting frame for detachably mounting the cable connector onto the printed wiring board. The present invention provides laborsaving mounting of a cable connector onto a printed wiring board.

23 Claims, 5 Drawing Sheets

CONNECTOR FOR CONNECTING FLEXIBLE FLAT CABLE TO PRINTED WIRING BOARD

BACKGROUND OF THE INVENTION

1. Field of the Invention

The invention relates to a connector to be used for connecting a flat cable to a printed wiring board, and more particularly to a small-sized connector capable of being mounted on a board. The invention also relates to a printed wiring board to be used together with such a connector.

2. Description of the Related Art

In general, a conventional cable connector has been mounted on a printed wiring board by putting a connector body on a board and then mechanically fixing the connector body to the board, for instance, by soldering. One of such conventional cable connectors has been suggested in Japanese Unexamined Patent Publication No. 4-129186 and A. Shimada "0.5 mm Pitch FPC Connector with Temporary Holder" in Electronic Packaging Technology, Vol. 10, No. 10, pp. 74–75, October 1994.

FIG. 1 illustrates a typical, conventional cable connector. An illustrated conventional cable connector includes a connector 500 for electrically connecting a flexible printed circuit (FPC) 601 to a plurality of pads 703 disposed on a printed wiring board 701. The connector 500 includes a terminal section 501, a pair of connection portions 502 disposed at opposite ends of the connector 500, and a slidable section 503 having an opening 504 through which FPC 601 is connected to the terminal section 501. The connector 500 is fixed onto the printed wiring board 701 by soldering the connection portions 502 onto fixation pads 702*a* and 702*b* formed on the printed wiring board 701.

When the connector 500 is to mount on the board 701, the connector 500 is made to move in a direction indicated with an arrow D, and then the connection portions 502 are soldered onto the fixation pads 702*a* and 702*b* to thereby mechanically connect the connector 500 to the printed wiring board 701. Concurrently, the terminal section 501 of the connector 500 is soldered to the pads 703 to thereby establish electrical connection therebetween. Then, FPC 601 is made to move in a direction indicated with an arrow E to enter the opening 504 of the connector 500. Then, the slidable section 503 is pushed into the connector 500 in a direction indicated with an arrow F. Thus, FPC 601 is electrically and mechanically connected to the connector 500.

When FPC 601 is to disengage from the connector 500, the slidable section 503 is made to move in a direction reverse to the arrow F, and then, FPC 601 is drawn out of the terminal section 501 in a direction reverse to the arrow E.

In the above mentioned conventional cable connector, a free end of FPC 601 is inserted into the opening 504 and then the slidable section 503 has to be pushed along the arrow F for connecting FPC 601 to the terminal section 501.

However, FPC 601 has high flexibility and the slidable section 503 of the connector 500 is small in size, and hence, it is not easy to carry out the above mentioned handling for connection with operator's hands. In addition, even if a cable connector as illustrated in FIG. 1 is to be automatically mounted on a printed wiring board with a mounting apparatus, it is unavoidable that the movement of such a mounting apparatus is complicated with the result of too much cost. Furthermore, the use of the slidable section 503 degrades the reliability on contact of the FPC 601 to the pads 703.

SUMMARY OF THE INVENTION

It is an object of the present invention to provide a cable connector which provides laborsaving handling for connection of FPC to a printed wiring board, and which is able to be applied to an apparatus by which connectors can be automatically mounted onto a printed wiring board, and further which provides higher reliability on contact of FPC to a printed wiring board.

In one aspect, the present invention provides a cable connector including (a) a plurality of contacts, one end of which has a connector for connecting the contacts to cable conductors extending from a flat cable, (b) a supporting frame having an opening therein and an insulator portion for supporting the plurality of contacts intermediate between opposite ends of the contacts so that the contacts are electrically insulated from one another, and the other end of the plurality of contacts are able to make contact with a pad disposed on a printed wiring board through the opening when the cable connector is mounted on the printed wiring board, and (c) a mounting device formed on the supporting frame for detachably mounting the cable connector onto the printed wiring board.

The connector may be formed in any shape, unless it can be connected with cable conductors of a flat cable. For instance, the connector may be formed in a U-shaped groove or a hollow pipe into which the cable conductor is to be inserted.

The contacts supported by the supporting frame may be arranged in a line or in a zigzag fashion so that diameters of the contacts overlap with one another.

It is preferable for the other end of the contacts to have a bending portion so that the contacts is upwardly urged by the printed wiring board when the cable connector is mounted onto the printed wiring board.

The mounting device may be formed in a projection which may include first and second pillar sections. The first pillar portion is connected at one end thereof to a bottom surface of the supporting frame, and a second pillar portion is continuously connected to the first pillar portion at the other end of the first pillar portion. The second pillar portion has a wider width than the first pillar portion and extends in parallel with the bottom surface of the supporting frame, and is to be inserted into an opening formed in the printed wiring board.

The second pillar portion is preferably circular in shape, and in addition, the first pillar portion preferably has an arcuate circumference. For instance, the first pillar portion is elliptical in shape.

It is preferable for the supporting frame to have a pair of extended portions between which the one end of the contacts are to be located. These extended portions are spaced away from each other by a distance equal to or slightly greater than a width of the flat cable.

In another aspect, the present invention provides a printed wiring board having an opening including continuously formed first and second sections. This printed wiring board is to be used with the above mentioned cable connector. The second pillar portion is designed to be able to pass through the first section, and the first pillar portion is designed to be able to fit into the second section. The second projection is to be located in the first section when the first projection is inserted into the opening of the printed wiring board.

It is preferable that the first section is circular in shape and the second section is half-elliptical in shape.

In still another aspect, the present invention provides a combination of a cable connector such as the above mentioned ones and a printed wiring board to be used with the cable connector, such as the above mentioned ones.

The present invention makes the handling for connection of FPC to a printed wiring board laborsaving, even if the FPC is to be connected to a cable connector. In addition, the cable connector made in accordance with the present invention can be applied to an apparatus by which connectors can be automatically mounted onto a printed wiring board, resulting in higher efficiency of mounting connectors on a printed wiring board. Furthermore, since a terminal section is compressed onto pads disposed on a printed wiring board, it is possible to have a clean surface at which the terminal section and pads contact with each other, resulting in higher quality of a printed wiring board.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

Preferred embodiments in accordance with the present invention will be explained hereinbelow with reference to drawings.

Figure 1:
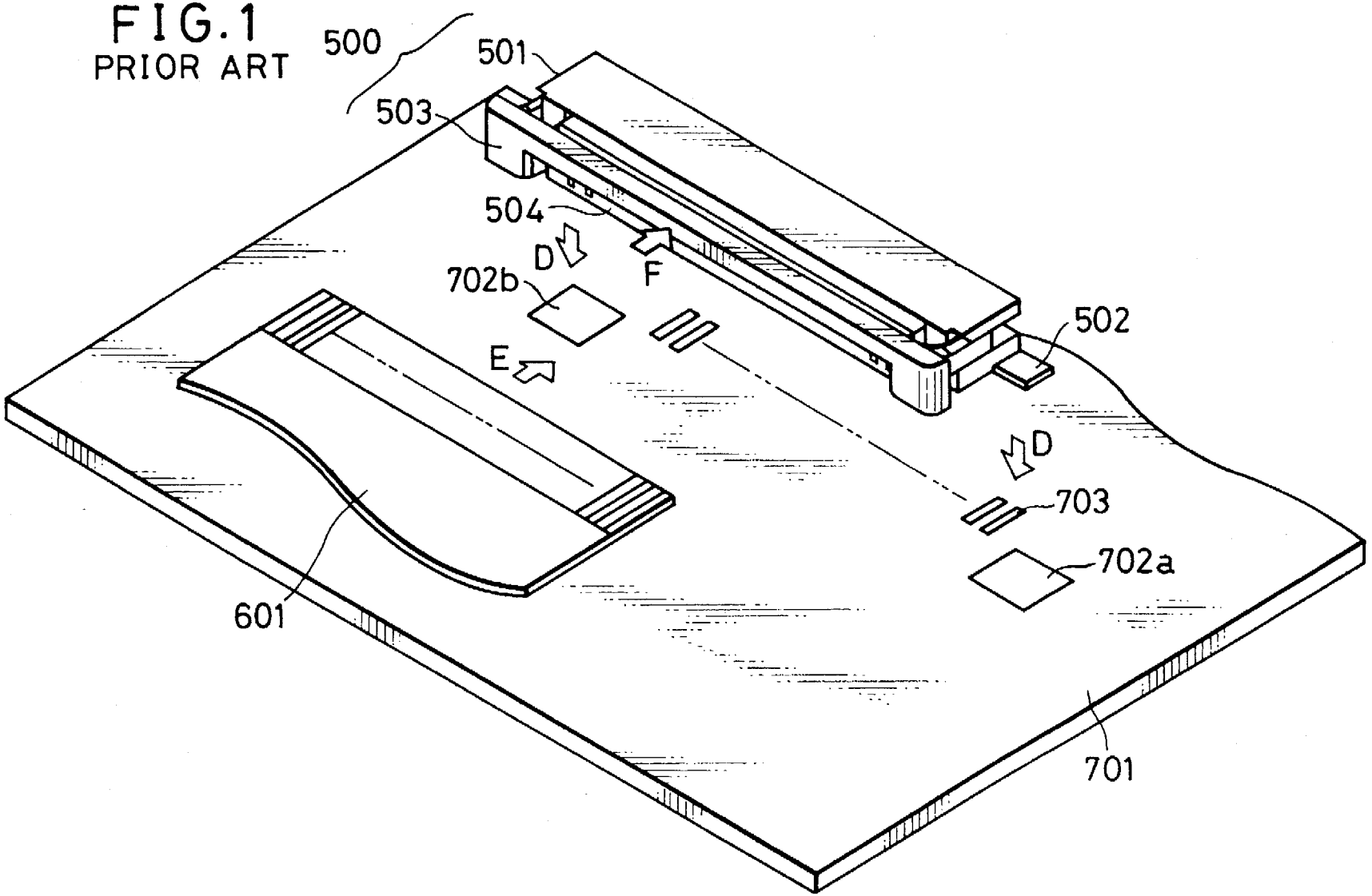
FIG. 1 PRIOR ART
FIG. 1 is a perspective view illustrating a conventional combination of a cable connector, a cable and a printed wiring board.
Figure 2:
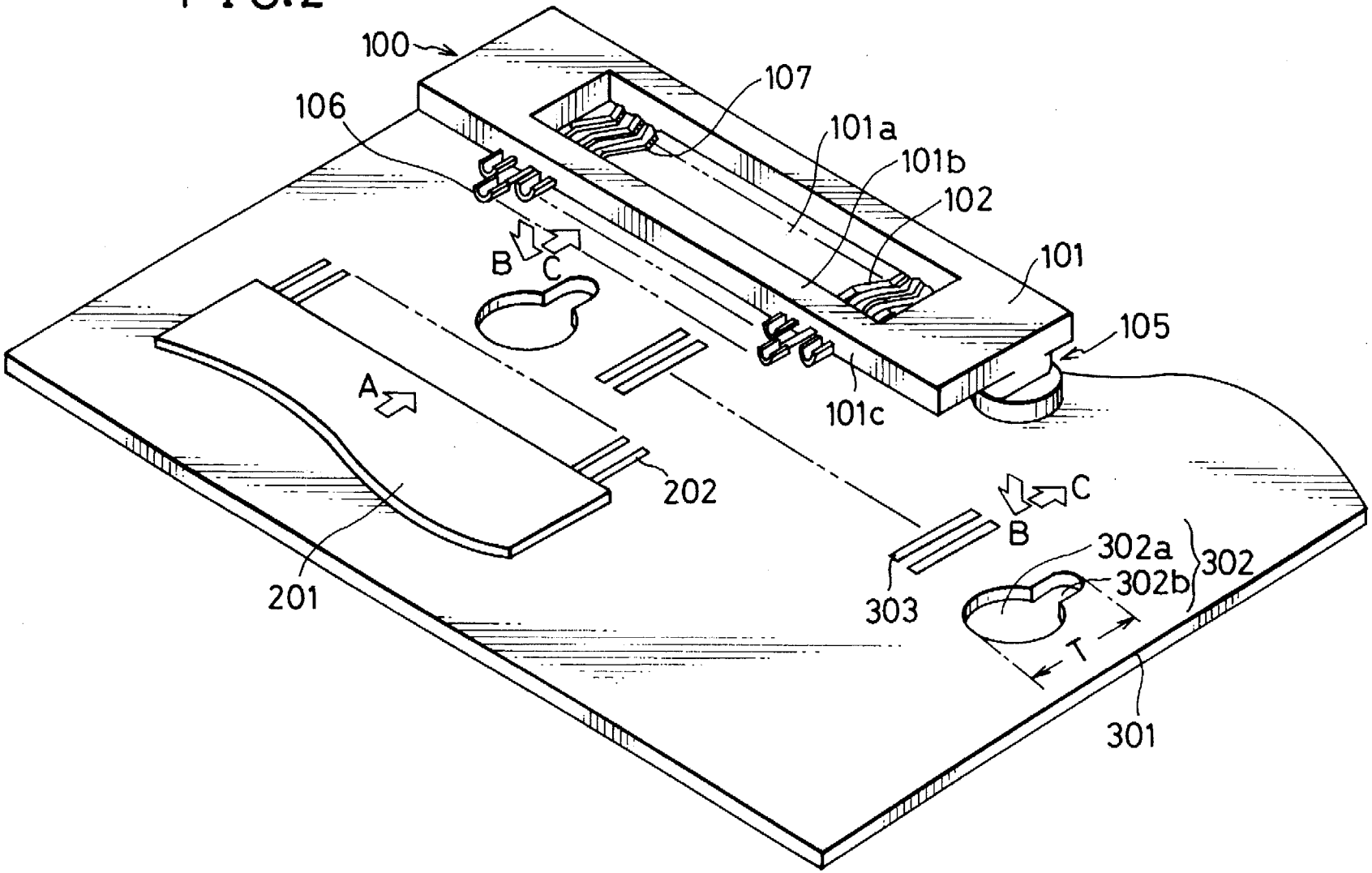
FIG. 2 is a perspective view illustrating a combination of a cable connector made in accordance with the first embodiment of the present invention, a cable and a printed wiring board.

With reference to FIG. 2, a cable connector 100 made in accordance with the first embodiment of the present invention includes a plurality of contacts 102 and a rectangular shaped supporting frame 101. The supporting frame 101 is formed with a rectangular opening 101*a* therein. The supporting frame 101 has an insulator portion 101*b* with which the contacts 102 are supported intermediate between opposite ends of the contacts so that the contacts 102 are electrically insulated from one another. Thus, the opposite ends of each of the contacts 102 are exposed outside the supporting frame 101.

As is obvious in FIG. 2, each of the contacts 102 has an end formed in a U-shaped groove 106. The other end of each of the contact 102 is formed with a bending portion 107. The bending portion 107 of each of the contacts 102 is to make contact with each of pads 303 formed on a printed wiring board 301. As mentioned later, the bending portion 107 ensures that the other end of the contacts 102 is upwardly urged by the printed wiring board 301 when the cable connector 100 is mounted onto the printed wiring board 301, thereby providing stable connection between the contacts 102 and the printed wiring board 301.

As illustrated in FIG. 2, the contacts 102 are supported by the insulator portion 101*b* in a zigzag fashion so that diameters of the contacts 102 overlap with one another as viewed from the top. A plurality of cable conductors 202 extending from a flexible flat cable 201 are to be connected with the contacts 102 through the U-shaped grooves 106. Even if the cable conductors 202 are arranged in small pitch, the zigzag arrangement of the contacts 102 ensures high density connection between the contacts 102 and the cable conductors 202 in a small space. If the cable conductors 202 are arranged in adequate pitch, the contacts 102 may be arranged in a line. On the printed wiring board 301 are formed the same number of the pads 303 as that of the cable conductors 202.

The cable conductors 202 are connected to the U-shaped grooves 106 of the contacts 102 by press-fitting, soldering or welding.

The insulator portion 101*b* of the supporting frame 101 has a surface 101*c* extending straight and flat. The ends of the contacts 102 at which the U-shaped grooves 106 are formed extend through the flat surface 101*c*.

Figure 3A:
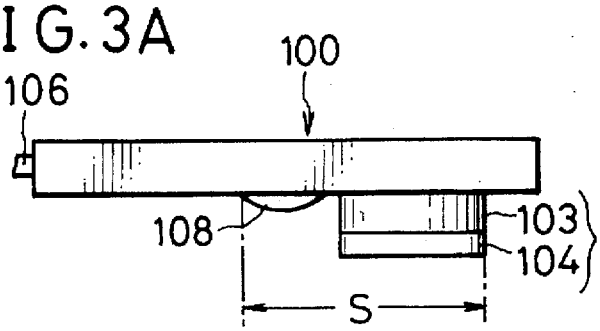
FIG. 3A is a side view of the cable connector illustrated in FIG. 2.

The supporting frame 101 is formed at a bottom surface thereof with a pair of projections 105 for detachably mounting the cable connector 100 onto the printed wiring board 301. As illustrated in FIG. 3D, each of the projections 105 comprises a first pillar portion 103 and a second pillar portion 104. The first pillar portion 103 is generally an elliptical pillar in shape. The first pillar portion 103 is fixedly connected at an upper surface thereof with a bottom surface of the supporting frame 101 so that the first pillar portion 103 extends in a direction at which the contacts 102 are extending. The second pillar portion 104 is a circular pillar in shape, and is fixedly connected at an upper surface thereof with a lower surface of the first pillar portion 103 of the projection 105 so that the upper surface of the second pillar portion 104 is in parallel with a bottom surface of the supporting frame 101.

Figure 3B:
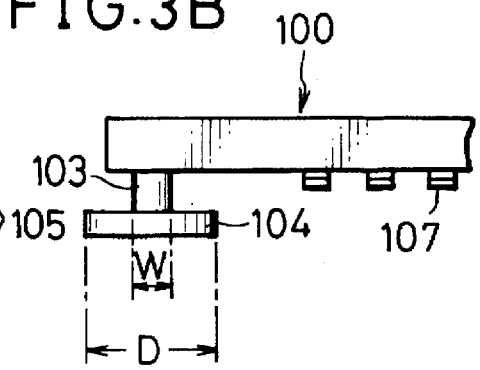
FIG. 3B is a rear view of the cable connector illustrated in FIG. 2.

As best shown in FIG. 3B, the second pillar portion 104 has a diameter D greater than a width W of the first pillar portion 103.

The first and second pillar portions 103 and 104 may be separately formed and connected to each other, and then connected to the supporting frame 101. As an alternative, the supporting frame 101 and the first and second pillar portions 103 and 104 may be integrally molded.

In the printed wiring board 301 are formed a pair of openings 302 into which the projections 105 of the supporting frame 101 are inserted to thereby secure the cable connector 101 to the printed wiring board 301. As illustrated in FIG. 2, each of the openings 302 includes a first section 302*a* and a second section 302*b*. The first and second sections 302*a* and 302*b* are continuously formed. The first section 302*a* is circular in shape, and is designed so that the second pillar portion 104 of the projection 105 is able to pass therethrough. The second section 302*b* is a half of an ellipse in shape, and is designed so that the first pillar portion 103 of the projection 105 is able to fit thereinto and slide therealong. The second section 302*b* extends in parallel with the strip-shaped pads 303.

Figure 3C:
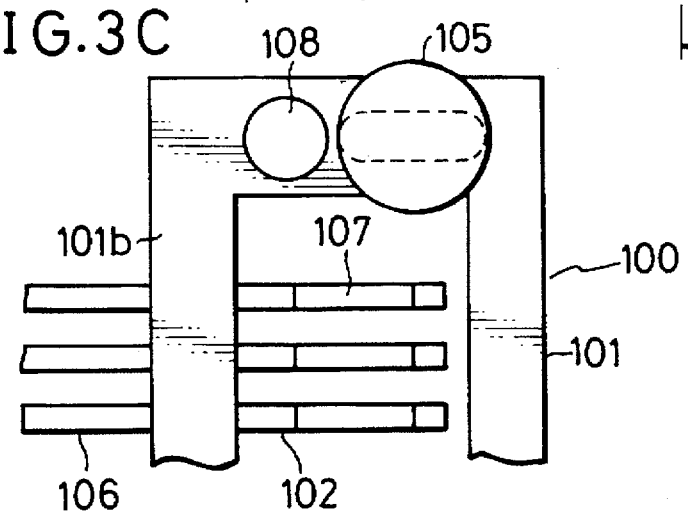
FIG. 3C is a bottom view of the cable connector illustrated in FIG. 2.
Figure 3D:
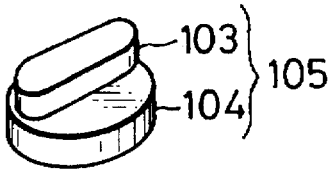
FIG. 3D is a perspective view of the cable connector illustrated in FIG. 2.

As illustrated in FIGS. 3A and 3C, at a bottom surface of the supporting frame 101 is formed a lock 108 located adjacent to the projection 105. The projection 105 and the lock 108 are positioned in a line extending in parallel with the contacts 102, and the lock 108 is located closer to the U-shaped grooves 106 of the contacts 102 than the projection 105.

As illustrated in FIG. 3A, the lock 108 is hemispherical in shape. The lock 108 may be formed in any shape, unless it projects from a bottom surface of the supporting frame 101. However, it is most preferable to form the lock 108 to be hemispherical.

A space between the projection 105 and the lock 108 is determined so that a total distance S (see FIG. 3A) covering both of them is equal to or slightly smaller than a longitudinal length T (see FIG. 2) of the opening 302.

As best shown in FIG. 3A, the lock 108 has a smaller height than the first pillar portion 103. If the lock 108 is sufficiently high, the lock 108 obstructs the insertion of the projection 105 into the opening 302. Thus, a height of the lock 108 is determined so that the lock 108 does not obstruct the insertion of the projection 105 into the opening 302.

Hereinbelow is explained how the flat cable 201 is connected to the printed wiring board 301 by means of the cable connector 100. With reference to FIG. 2, the flexible flat cable 201 is first made to move in a direction indicated with an arrow A in parallel with a plane of the printed wiring board 301, and then the cable conductors 202 extending from the flat cable 201 are made to be engaged to the U-shaped grooves 106 of the contacts 102. Then, the cable conductors 202 and the U-shaped grooves 106 are soldered or welded to thereby obtain mechanical and electrical connection therebetween.

Then, the cable connector 100 to which the flat cable 201 has already been connected is made to move in a direction indicated with an arrow B vertically to a plane of the printed wiring board 301 to thereby cause the second pillar portion 104 of the projections 105 to fit into the first section 302*a* of the openings 302. Then, the cable connector 100 is made to slide in a direction indicated with an arrow C to thereby cause the first pillar portion 103 to slide within and along the second section 302 of the openings 302.

Thus, the cable connector 100 is mechanically secured to the printed wiring board 301, and the bending portions 107 of the contacts 102 come to make strong contact with the pads 303 to thereby establish electrical connection between the contacts 102 and the printed wiring board 301.

When the cable connector 100 is to disengage from the printed wiring board 301, the cable connector 100 is made to slide in a direction reverse to the arrow C, and then lift up in a direction reverse to the arrow B.

Hereinbelow is explained the operation of the projections 105 and the locks 108 with reference to FIGS. 4A and 4B.

Figure 4A:
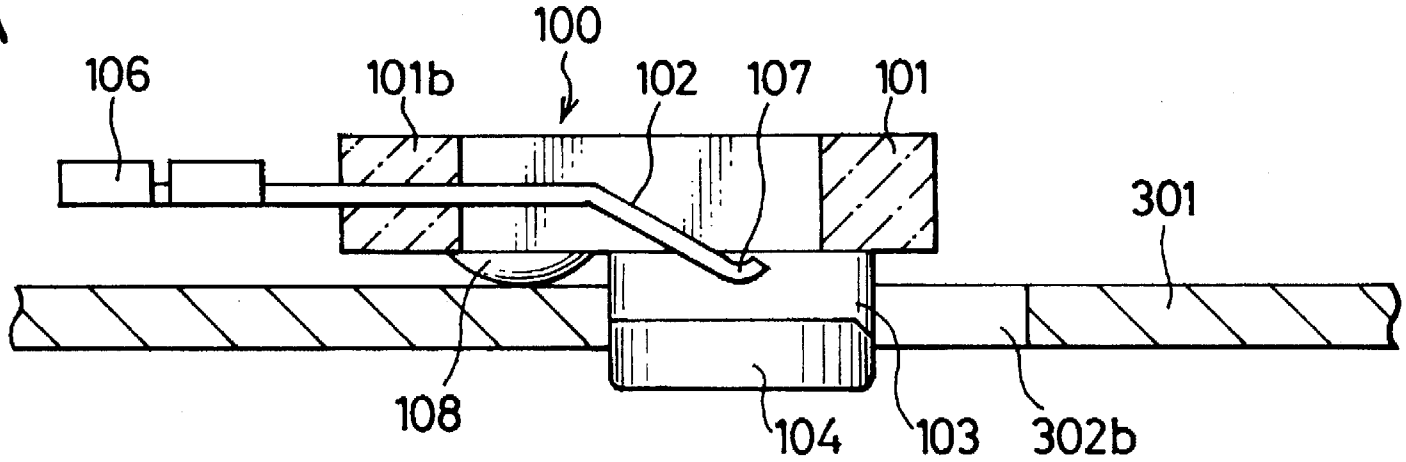
FIG. 4A is a cross-sectional view of the cable connector illustrated in FIG. 2 and a printed wiring board before the cable connector is fixed onto the printed wiring board.

As illustrated in FIG. 4A, when the second pillar portion 104 of the projection 105 is fit into the first section 302*a* of the opening 302, the hemispherical projection 108 makes contact with the printed wiring board 301 at a lowermost point thereof. As the first pillar portion 103 of the projection 105 is made to slide within the second section 302*b* of the opening 302, the cable connector 100 is temporarily resiliently deformed, and the hemispherical projection 108 finally comes to be accommodated in the first section 302*a* of the opening 302. Thus, the cable connector 100 is fixedly and intimately connected to the printed wiring board 301.

Figure 4B:
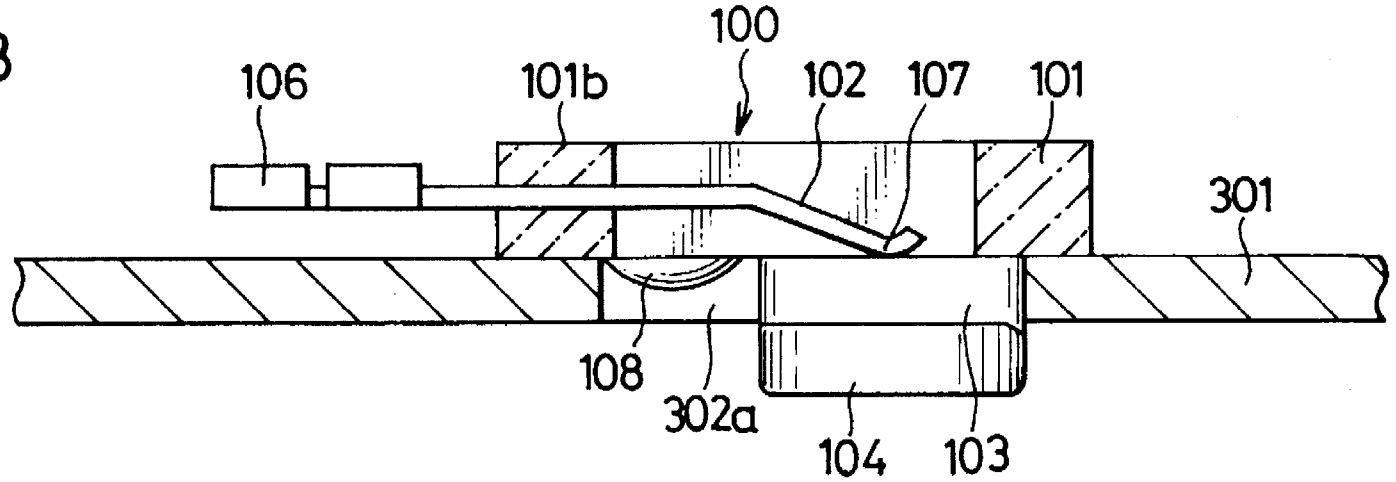
FIG. 4B is a cross-sectional view of the cable connector illustrated in FIG. 2 and a printed wiring board after the cable connector was fixed onto the printed wiring board.

In this state, as illustrated in FIG. 4B, the bending portion 107 of the contact 102 is compressed onto the pad 303 (not illustrated in FIG. 4B). Since the bending portion 107 tends to bend downwardly against a counterforce exerted by the printed wiring board 301, there can be obtained intimate contact between the contact 102 and the pad 303.

When the cable connector 100 is to disengage from the printed wiring board 301, the cable connector can be readily released from the printed wiring board 301 by causing the cable connector 100 to move in the reverse direction, because the lock 108 is formed to be arcuate.

As having been explained, in the cable connector made in accordance with the first embodiment, the insulator portion 101*b* is formed integrally with the contacts 102. The flat cable 201 is connected to one end of the contacts 102, and the other end of the contacts 102 are connected to the pads 303 disposed on the printed wiring board 301 to thereby establish electrical connection between the flat cable 201 and the printed wiring board 301. The mechanical connection between the cable connector 100 and the printed wiring board 301 is accomplished by means of the pair of the projections 105 formed on a bottom surface of the supporting frame 101. The projections 105 are fit into the openings 302, and are made slide within the openings 302, thereby the cable connector 100 being mechanically connected to the printed wiring board 301.

Figure 5:
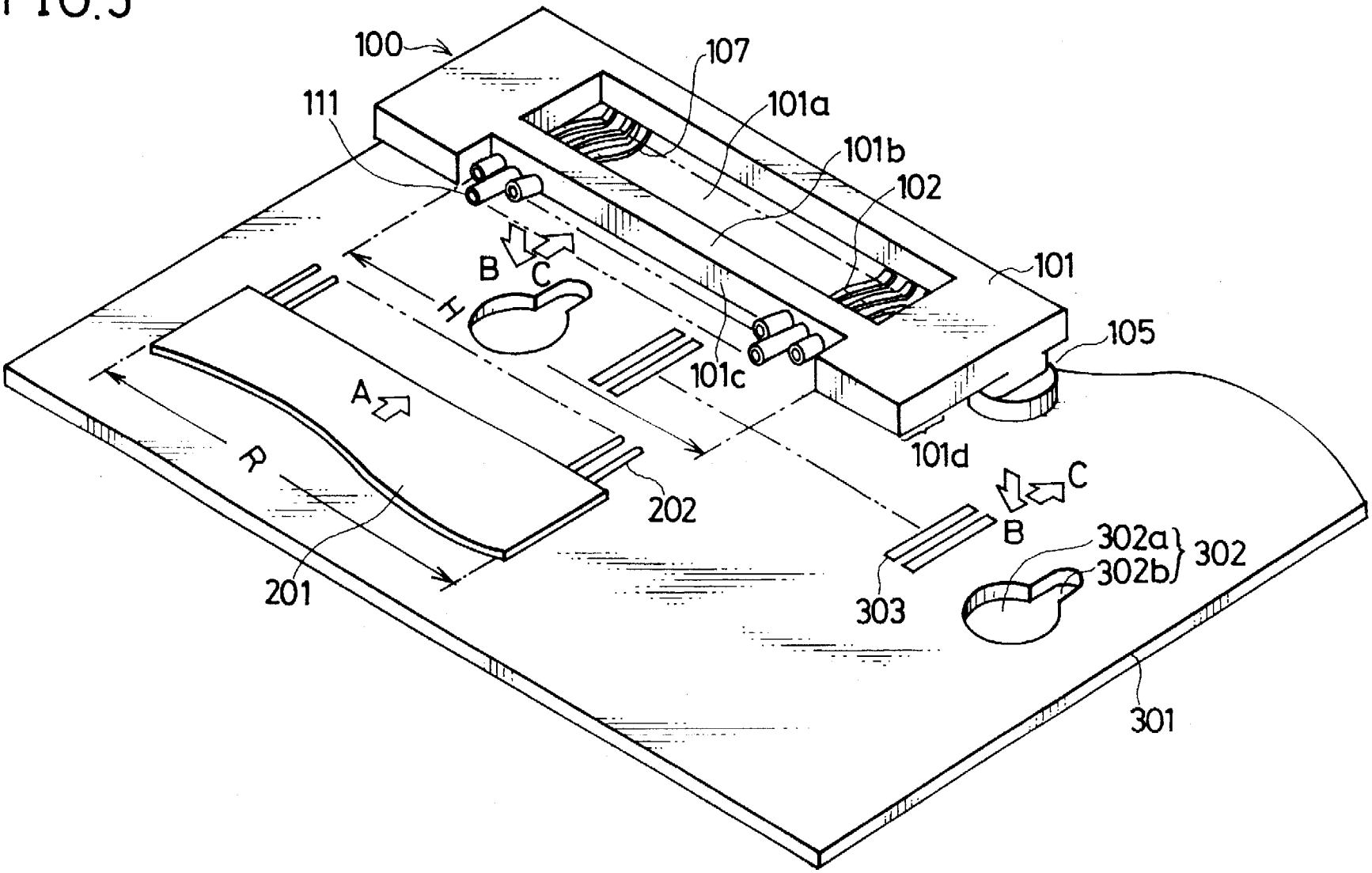
FIG. 5 is a perspective view illustrating a combination of a cable connector made in accordance with the second embodiment of the present invention, a cable and a printed wiring board.

FIG. 5 illustrates a cable connector made in accordance with the second embodiment of the present invention. The second embodiment is different from the first embodiment in the following two points: the supporting frame 101 is formed with a pair of extended portions 101*d*; and each of one end of the contacts 102 constitute a hollow pipe 111 in place of the U-shaped groove 106. The second embodiment has the same structure as the first embodiment other than these two points. Parts or elements of the second embodiment that correspond to those of the first embodiment have been provided with the same reference numerals, and explanation about them will be omitted.

The pair of the portions 101*d* extend from the supporting frame 101 at opposite ends of the frame 101, and have almost the same length as the exposed ends of the contacts 102. The contacts 102 extend from the surface 101*c* of the supporting frame 101 between the extended portions 101*d*. The pair of the extended portions 101*d* are spaced away from each other by a distance H equal to or slightly greater than a width R of the flexible flat cable 201.

When the flat cable 201 is to connect to the cable connector 100, the cable conductors 202 are inserted into the hollow pipes 111. Then, the cable conductors 202 are soldered or welded to the hollow pipes 111 to thereby establish mechanical connection therebetween. Then, the cable connector 100 is mounted onto the printed wiring board 301 in the same way as the first embodiment.

The second embodiment provides the same advantages as those of the first embodiment, and further provides advantages beyond those of the first embodiment. The insertion of the cable conductor 202 into the hollow pipes 111 of the contacts 102 provides more stable connection therebetween than the first embodiment in which the cable conductors 202 are just put onto the U-shaped grooves 106. In addition, the flexible flat cable 201 is able to be fit between the extended portions 101*d* of the supporting frame 101, resulting in more stable connection between the flat cable 201 and the cable connector 100.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A cable connector comprising:

a plurality of contacts one end of each of which has connecting means for connecting said contacts to cable conductors extending from a flat cable;

a supporting frame having an opening formed lengthwise along said supporting frame and an insulator portion for supporting said plurality of contacts intermediate between opposite ends of said contacts so that said contacts are electrically insulated from one another, and such that other ends of said plurality of contacts are able to make contact through said opening with a pad disposed beneath said contacts on a surface of a printed wiring board when said cable connector is mounted on said printed wiring board; and mounting means formed on a bottom surface of said supporting frame for detachably mounting said cable connector onto said printed wiring board.

2. The cable connector as set forth in claim 1, wherein said contacts are supported by said supporting frame in a line.

3. The cable connector as set forth in claim 1, wherein said other end of said contacts has a bending portion so that said other end of said contacts is upwardly urged by said printed wiring board when said cable connector is mounted onto said printed wiring board.

4. The cable connector as set forth in claim 1, wherein said mounting means comprises a projection.

5. The cable connector as set forth in claim 1, wherein said supporting frame has a pair of extended portions between which said one end of said contacts are to be located.

6. The cable connector as set forth in claim 4, wherein said mounting means further comprises a second projection formed on said supporting frame in adjacent relation to said projection, said second projection also being located in said opening of said printed wiring board when said projection is inserted in said opening of said printed wiring board.

7. A cable connector comprising:

a plurality of contacts, one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another and such that other ends of said plurality of contacts are able to make contact with a pad disposed on a printed wiring board through said opening when said cable connector is mounted on said printed wiring board; and mounting means formed on said supporting frame for detachably mounting said cable connector onto said printed wiring board;

wherein said connecting means comprises a U-shaped groove.

8. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board; and mounting means formed on said supporting frame for detachably mounting said cable connector onto said printed wiring board;

wherein said connecting means comprises a hollow pipe into which said cable conductor is to be inserted.

9. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board; and mounting means formed on said supporting frame for detachably mounting said cable connector onto said printed wiring board;

wherein said contacts are supported by said supporting frame in a zigzag fashion so that diameters of said contacts overlap with one another.

10. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board; and mounting means formed on said supporting frame for detachably mounting said cable connector onto said printed wiring board;

wherein said mounting means comprises a projection; and wherein said projection comprises a first pillar portion connected at one end thereof to a bottom surface of said supporting frame and a second pillar portion continuously connected to said first pillar portion at the other end of said first pillar portion, said second pillar portion having a wider width than said first pillar portion and extending in parallel with said bottom surface of said supporting frame, and said second pillar portion being inserted into an opening formed in said printed wiring board.

11. The cable connector as set forth in claim 10, wherein said second pillar portion is circular in shape.

12. The cable connector as set forth in claim 11, wherein said first pillar portion has an arcuate circumference.

13. The cable connector as set forth in claim 12, wherein said first pillar portion is elliptical in shape.

14. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board; and mounting means formed on said supporting frame for detachably mounting said cable connector onto said printed wiring board;

wherein said supporting frame has a pair of extended portions between which said one end of said contacts are to be located; and wherein said pair of extended portions are spaced away from each other by a distance equal to or slightly greater than a width of said flat cable.

15. A printed wiring board having an opening comprising continuously formed first and second sections, said printed wiring board to be used with a cable connector, said cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board;

a first projection formed on said supporting frame for detachably mounting said cable connector onto said printed wiring board, said first projection including a first pillar portion connected at one end thereof to a bottom surface of said supporting frame and a second pillar portion continuously connected to said first pillar portion at the other end of said first pillar portion, said second pillar portion having a wider width than said first pillar portion and extending in parallel with said bottom surface of said supporting frame; and a second projection formed on said supporting frame in adjacent relation with said first projection, said second pillar portion being designed to be able to pass through said first section, and said first pillar portion being designed to be able to fit into said section, said second projection to be located in said first section when said first projection is inserted into said opening of said printed wiring board.

16. The printed wiring board as set forth in claim 15, wherein said first section is circular in shape and said second section is half-elliptical in shape.

17. A combination of a cable connector and a printed wiring board to be used with a cable connector, said cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board;

mounting means formed on said supporting frame for detachably mounting said cable connector onto said printed wiring board, said mounting means including a first pillar portion connected at one end thereof to a bottom surface of said supporting frame and a second pillar portion continuously connected to said first pillar portion at the other end of said first pillar portion, said second pillar portion having a wider width than said first pillar portion and extending in parallel with said bottom surface of said supporting frame, said printed wiring board having an opening comprising continuously formed first and second sections, said second pillar portion being designed to be able to pass through said first section, and said first pillar portion being designed to be able to fit into said second section.

18. The combination as set forth in claim 17, wherein said second pillar portion is circular in shape.

19. The cable connector as set forth in claim 17, wherein said first pillar portion has an arcuate circumference.

20. The combination as set forth in claim 19, wherein said first pillar portion is elliptical in shape.

21. The combination as set forth in claim 17, wherein said supporting frame has a pair of extended portions between which said one end of said contacts are to be located.

22. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board, wherein said printed wiring board comprises continuously formed first and second sections; and mounting means formed on said supporting frame for detachably mounting said cable connector onto said printed wiring board.

23. A cable connector comprising:

a plurality of contacts one end of each of which has connecting means for connecting said contacts to cable conductors extending from a flat cable;

a supporting frame having an opening therein and an insulator portion for supporting said plurality of contacts intermediate between opposite ends of said contacts so that said contacts are electrically insulated from one another, and such that other ends of said plurality of contacts are able to make contact with a pad disposed on a printed wiring board through said opening when said cable connector is mounted on said printed wiring board; and mounting means comprising first and second pillar portions, said first pillar portion connected to said supporting frame and said second pillar portion continuously connected to said first pillar portion, for detachably mounting said cable connector onto said printed wiring board.

* * * * *